US006372049B1

(12) United States Patent
Shimanskaya et al.

(10) Patent No.: US 6,372,049 B1
(45) Date of Patent: Apr. 16, 2002

(54) METHOD OF PRODUCING SUGAR SYRUP FROM SUGAR-CONTAINING RAW MATERIALS

(75) Inventors: Tatyana Mihaylovna Shimanskaya; Andrey Arkadjevich Shimansky, both of Engelsa; Valentina Ivanovna Kiseleva, Gagarina, all of (RU)

(73) Assignee: Centre for the Advancement of New Technologies "CANTEC", Obninsk (RU)

( * ) Notice: Subject to any disclaimer, the term of this patent is extended or adjusted under 35 U.S.C. 154(b) by 0 days.

(21) Appl. No.: 09/424,914

(22) PCT Filed: May 18, 1998

(86) PCT No.: PCT/RU98/00147

§ 371 Date: Mar. 1, 2000

§ 102(e) Date: Mar. 1, 2000

(87) PCT Pub. No.: WO98/55658

PCT Pub. Date: Dec. 10, 1998

(30) Foreign Application Priority Data

Jun. 2, 1997 (RU) ..... 97109286

(51) Int. Cl.[7] ..... C13D 3/14; C13D 3/16
(52) U.S. Cl. ..... 127/46.2
(58) Field of Search ..... 127/46.2, 48, 54, 127/55

(56) References Cited

U.S. PATENT DOCUMENTS 3,781,174 A * 12/1973 Nishijima et al. ..... 127/46.2
4,492,601 A * 1/1985 Nakasone et al. ..... 127/48

FOREIGN PATENT DOCUMENTS

JP 02080000 A * 3/1990 ..... 127/46.2
RU 2114177 2/1997 ..... C13D/3/16

OTHER PUBLICATIONS

Derwent Acc. No. 1995–104752, Saldadze, Abstract of RU 2016637, Jul. 1994.*

* cited by examiner

*Primary Examiner*—David Brunsman
(74) *Attorney, Agent, or Firm*—Morgan & Finnegan, L.L.P.

(57) ABSTRACT

The invention permits to realize production of sugar syrup of refined purity simultaneously with harvesting. The invention is in creating new technological process, which includes thermal and acidic treatment of sugar-containing juice, electrochemical treatment, ultrafiltration, electrodialysis, ion-exchange and sorbent treatment, juice concentration by reverse osmosis and completing evaporating which ensures long-term storing. The technological rules of juice treating secure a trustworthy operating lifetime of ultrafiltrative, reverse osmosis and ion exchange membranes for the period of processing the crop. The sugar-containing product, obtained from the usage of the invention can be used in confectionery, bakery, canning industry, beer and non-alcohol production.

5 Claims, No Drawings

METHOD OF PRODUCING SUGAR SYRUP FROM SUGAR-CONTAINING RAW MATERIALS

This application is a 371 of PCT/RU98/00147 filed May 18, 1998.

TECHNICAL SPHERE

The invention relates to the sugar industry. The sugar-containing product, obtained from the usage of the invention can be used in confectionery, bakery, canning industry, beer and non-alcohol production. The invention permits to realize production of sugar syrup of refined purity simultaneously with harvesting, without any subsidiary production.

The Previous Level

It is known that exists the method of obtaining sugar syrup as an intermediate product in conventional processing of sugar [A. R. Sapronov, L. D. Bobrovnik <<Sugar>>, Moscow, <<Light and food industries>>, 1981.]. The method includes obtaining of diffusion juice, its purification by defecosaturation and evaporation. The shortcomings of this method are high power expenditures for evaporation and insufficient quality of syrup, which requires an expensive procedure of run-off purification to obtain white crystalline sugar from sugar syrup. Moreover conventional processing proposes existing of subsidiary productions such as water treatment, lime-gas, thermal power production, sugar-beet warehouses in one complex with sugar production. The most similar to the announced method is a method of obtaining syrup from sugar-containing materials, including juice purification of impurities by mechanical filtration, ultrafiltration of juice, ion-exchange purification by passing through anionite and cationite, concentration of solution by reverse osmosis and evaporating to make it syrup. [RU, patent 2016637, C 13 F 1/00, 1994.] The main shortcomings of this method are: low capacity of ultrafiltration conditioned by diffusion juice that is rich in high-molecular components and salt. The consequences of this are requirements of frequent regeneration of membranes and extremely slow regeneration of ionite mixture by a special solution, insufficient dessalting because of changing of cationite into $Na^+$form when regenerating.

DESCRIPTION OF INVENTION

The problem solved by the invention is working out a method of producing sugar syrup of refined purity from sugar-containing agricultural crops. The technical result of it is guaranteeing the same period of service life of used devices, improving quality of final product and creating ecologically clean process. It is reached because in the proposed method of producing sugar syrup from sugar-containing raw materials which includes chopping of raw material, obtaining juice, its ultrafiltration, ionexchange purification, concentration by reverse osmosis and evaporating to make it syrup; before ultrafiltration in this method juice or chopped material is purified by acidification to decrease pH level, it is heated up until proteins coagulate, then they are removed by filtration or centrifuging, electrolysis runs with using active electrodes, which give when dissolving polyvalent ions which provide coagulation of colloids with further removing of precipitate; the obtained product of ultrafiltration before ion-exchange purification is exposed to electrodialysis for its demineralization and then sugar-containing solution is passed through filter with sorbent. After electrolysis of juice in the case of insufficient coagulation there must be injected acid or salt of polyvalent metal for precipitation of colloids with subsequent separation of precipitate.

The Method is Put into Effect in the Following Way

Sugar-containing materials must be washed if necessary. Then they are chopped and for some of the crops must be made acidification by injecting a substance which decrease pH of the medium that makes proteins contained in the material coagulate. Juice is obtained from the chopped material by centrifuging, pressing or diffusion or by its' combination. The obtained juice is heated till coagulation of contained proteins and it is acidified (if there were no acidification of chopped material) by injecting a substance which decrease pH of surroundings till appearing of suspended precipitate. The precipitate is removed by filtration or centrifuging of juice. Purified in this way juice is exposed to electrolysis in the electrolyzer with active electrodes, which give when dissolving polyvalent ions; this process runs till coagulation of colloids contained in the juice. In the case of insufficient coagulation the electrolyzed solution must be treated with acid or solution of salt of polyvalent metal till precipitation of colloids. Then this precipitate is separated by filtration or centrifuging, after that ultrafiltration runs. Then ultrafiltrated juice passes to electrodialyzer, where electrodialysis proceeds for decreasing of contents of mineral substances that is proved by change of electrical conductivity of the juice. Then for complete demineralization the juice is passed through ion-exchange filters and for elimination of beet taste it is passed through filter with sorbent. After that there's conducted concentration of juice by reverse osmosis membranes and evaporating of obtained syrup until content of dry substances ensuring long-term storing without crystallization. The obtained sugar-containing product meets the requirements of color index, purity, microbiological characteristics and content of toxic substances and pesticide according to Russian Standard 22-94 for refined sugar. This quality of sugar-containing product permits to omit purification of run-off during production of crystalline sugar.

The Best Version of Realization of Invention

Diffusion beet juice which has sucrose=13.2%, purity coefficient=82%, dry substances=16.1% made from long-stored beet is heated till 90° C., acidificated by hydrochloric acid till pH=4.5; the appearing precipitation of proteins is filtrated. This obtained precipitation is protein-polysaccharide concentrate, which doesn't contain any harmful substances and can be added to pressed beet for feeding cattle. The filtered juice which has purity coefficient=89% is electrolyzed in electrolyzer with aluminum electrodes with potential between electrodes of 2.5 V, current density of 5 $A/cm^2$ up to beginning of precipitating of aluminum hydroxide. To electrolyzed solution must be injected with mixing a 30% solution of aluminum sulfate until apparent division of phases ; then the solution is filtered to remove the precipitate. The filtrated electrolyzed substance has purity coefficient=91.6%, it doesn't contain coloring impurities, contains a small quantity of high-molecular compounds and has pH=6.95. The electrolyzed substance is exposed to ultrafiltration for removing of residual high-molecular compounds with a pressure of 0.3 Pa on membranes made of aromatic polyamide. The ultrafiltrated substance is treated in electrodialyzer with ion exchange membranes MK-40 and MA-40 and measure it's electrical conductivity. After achieving a tenfold decreasing the process is stoped. Then demineralization is conducted step-by-step on cationite IMAC BP 1110, anionite IMAC HP 661 and cationite IMAC HP 336 and then it is purified on activated carbon. The obtained solution has content of dry substances=13%, purity coefficient=99.9% and zero color index. Then the obtained solution is concentrated by reverse osmosis on membranes made of aromatic polyamide till sucrose content of 35% and then the concentrate is evaporated till sucrose content of 60%. After evaporation the substance has zero color index, purity coefficient 99.9%, that means, it meets the requirements of Russian standard 22-94 for refined sugar.

INDUSTRIAL APPLICATION

On the basis of the proposed method of production of sugar syrup can be created refineries of a new type, which'll make the process of producing sugar syrup from any sugar-containing material profitable and it'll meet up-to-date ecological requirements. Processing on such refineries will guarantee an even distribution of working load during purification for all steps of technological process and also it'll guarantee the same operating lifetime of facilities, it'll improve the conditions of work of ultrafiltration and reverse osmosis units and evaporator. In producing sugar from sugar syrup obtained according to the proposed method, it'd be unnecessary to purify run-off, because the syrup will have a refined sugar purity.

What is claimed is:

1. A method of producing sugar syrup from sugar-containing raw materials comprising the steps of:

(a) chopping raw material;

(b) obtaining juice;

(c) heating said juice to coagulate proteins;

(d) acidifying to coagulate proteins;

(e) removing said coagulated proteins by filtration or centrifugation;

(f) coagulating colloids by electrolysis;

(g) removing coagulated colloids by filtration or centrifugation;

(h) removing residual precipitate by ultrafiltration;

(i) demineralizing by electrodialysis;

(j) purifying by ion-exchange;

(k) filtering with a sorbent;

(l) concentrating by reverse osmosis; and (m) evaporating to make syrup.

2. The method of claim 1, wherein the acidification step (d) is done after chopping raw materials, step (a), and prior to obtaining the juice, step (b).

3. The method of claim 1, wherein colloids are further precipitated after the electrolysis step (f) by injecting an acid or salt of a polyvalent metal.

4. The method of claim 3 wherein said acid or salt of the polyvalent metal is aluminum sulfate.

5. The method of claim 1, wherein said juice is obtained by centrifugation, pressing, or diffusion, or some combination thereof.

* * * * *